US011766068B1

(12) United States Patent
Fariss et al.

(10) Patent No.: US 11,766,068 B1
(45) Date of Patent: Sep. 26, 2023

(54) METHOD OF TREATING SMOKELESS TOBACCO

(71) Applicant: Altria Client Services LLC, Richmond, VA (US)

(72) Inventors: Marc W. Fariss, Midlothian, VA (US); Jeffery Edmiston, Mechanicsville, VA (US); Dongmei Xu, Glen Allen, VA (US); Randall Baren, Glen Allen, VA (US); Yahya Kargalioglu, Glen Allen, VA (US); James A. Strickland, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 329 days.

(21) Appl. No.: 16/813,047

(22) Filed: Mar. 9, 2020

Related U.S. Application Data

(62) Division of application No. 12/966,481, filed on Dec. 13, 2010, now abandoned.

(60) Provisional application No. 61/286,231, filed on Dec. 14, 2009.

(51) Int. Cl.
*A24B 15/32* (2006.01)
*A24B 13/00* (2006.01)
*A24B 15/30* (2006.01)

(52) U.S. Cl.
CPC ..... *A24B 15/32* (2013.01); *A24B 13/00* (2013.01); *A24B 15/308* (2013.01)

(58) Field of Classification Search
None
See application file for complete search history.

(56) References Cited

U.S. PATENT DOCUMENTS 6,138,683 A 10/2000 Hersh et al.
6,444,470 B1 9/2002 Ross et al.
6,821,953 B1 * 11/2004 Rodgers et al. ..... C07K 7/14 514/3.3
6,845,777 B2 1/2005 Pera
2002/0179103 A1 12/2002 Hersh et al.
(Continued)

FOREIGN PATENT DOCUMENTS

WO 2008090552 A2* 7/2008 ..... A24B 13/00

OTHER PUBLICATIONS

Aubrey Francis Mendonca, "Mechanism of inhibitory action of potassium sorbate in Escherichia coli" (1992).
Bagchi et al., "Smokeless tobacco, oxidative stress, apoptosis, and antioxidants in human oral keratinocytes," Free Radical Biology & Medicine, Vol. 26, No. 7-8, pages 992-1000 (1999).
Domenico et al., "Potentiation of aminoglycoside inhibition and reduction of capsular polysaccharide production in Klebsiella pneumoniae by Sodium Salicylate," Journal of Antimicrobial Chemotherapy (1990) 25, pages 903-914, The British Society for Antimicrobial Chemotherapy.
Domenico et al., "Reduction of a Capsular Polysaccharide Production in Klebsiella pneumoniae by Sodium Salicylate," Infection and Immunity, Dec. 1989, pages 3778-3782, Vol. 57, No. 12, American Society for Microbiology.
(Continued)

*Primary Examiner* — Phu H Nguyen
(74) *Attorney, Agent, or Firm* — Harness, Dickey & Pierce, P.L.C.

(57) ABSTRACT

The method includes first adding at least one first chelator to smokeless tobacco, second adding at least one first antioxidant to the smokeless tobacco, the at least one first antioxidant being different than the at least one first chelator, and third adding at least one first flavorant to the smokeless tobacco, wherein the first adding occurs before the third adding.

29 Claims, 3 Drawing Sheets

(56) References Cited

U.S. PATENT DOCUMENTS

| | | | | |
|---|---|---|---|---|
| 2003/0138500 | A1* | 7/2003 | Parker et al. | A01N 59/02 514/65 |
| 2005/0244521 | A1 | 11/2005 | Strickland et al. | |
| 2006/0191548 | A1 | 8/2006 | Strickland et al. | |
| 2007/0062549 | A1 | 3/2007 | Holton et al. | |
| 2007/0116838 | A1* | 5/2007 | Prakash et al. | A61K 8/602 426/548 |
| 2007/0186941 | A1* | 8/2007 | Holton, Jr. et al. | A24B 15/283 131/347 |
| 2007/0261707 | A1 | 11/2007 | Winterson et al. | |
| 2008/0029110 | A1 | 2/2008 | Dube et al. | |
| 2008/0156338 | A1 | 7/2008 | Winterson et al. | |
| 2008/0202533 | A1 | 8/2008 | Mishra et al. | |
| 2009/0038631 | A1 | 2/2009 | Mishra et al. | |
| 2009/0098192 | A1 | 4/2009 | Fuisz | |
| 2009/0133704 | A1 | 5/2009 | Strickland et al. | |
| 2009/0301505 | A1 | 12/2009 | Liu et al. | |
| 2010/0108086 | A1* | 5/2010 | Reznick et al. | A24B 15/282 131/366 |

OTHER PUBLICATIONS

Fujikawa, R., et al. "Molecular Cloning, Expression, and Characterization of Secretory Phospholipase $A_2$ in Tobacco," Lipids, Vol. 40, No.9, pages 901-908 (2005).

http://www.encyclopedia.com/utility/printdocument.aspx?id=1G2:3409800226 (2003).

IARC Monographs, Smokeless Tobacco, 2007, World Health Organization, Volume 89, page 56.

Johnson, GK et al., "Development of smokeless tobacco-induced oral mucosal lesions." J.Oral Pathol. Med. 27, 388-394 (1998).

Kono et al., Iron Chelation by chlorogenic acid as a natural antioxidant, Bioscience, Biotechnology, and Chemistry, 1998, 62, 22-27.

Kustov A.V. et al., "The Complexion-Renal Stone Interaction: Solubility and Electronic Microscopy Studies," J. Phys. Chem. B (2009) 113, pages 9547-9550.

Mangipudy et al., "Role of nitric oxide in the induction of apoptosis by smokeless tobacco extract." Mol Cell Biochem. 200, 51-57 (1999).

Norberg et al., Free Radic. Biol. Med. 31:1287-1312.

Payne et al., "Histological alterations following short-term smokeless tobacco exposure in humans." J. Periodontal. Res 33, 274-279 (1998).

Petro, "Modulation of IL-12 p35 and p40 promoter activity by smokeless tobacco extract is associated with an effect upon activation of NF-kappaB but not IRF transcription factors." Int. Immunopharmacol. 3, 735-745 (2003).

Porasuphatana, S. Journal of Food Science 2008 73:S359-S366.

Santa-Maria. M.C. Biofuels and Environmental Biotechnology 2009 Preprint.

* cited by examiner

METHOD OF TREATING SMOKELESS TOBACCO

CROSS REFERENCE TO RELATED APPLICATIONS

This application is a divisional application of U.S. Application No. 12/966,481, filed on Dec. 13, 2010, which claims priority under 35 U.S.C. §119(e) to U.S. Provisional Application No. 61/286,231, filed on Dec. 14, 2009, the entire content of each of which is incorporated herein by reference.

BACKGROUND

A need exists for smokeless tobacco exhibiting improved shelf life. In particular, it is desirable for smokeless tobacco to have improved stability during storage.

SUMMARY

The disclosure may address one or more of the problems and deficiencies discussed above. However, it is contemplated that the disclosure may prove useful in addressing other problems and deficiencies, or provide benefits and advantages, in a number of technical areas. Therefore the claimed invention should not necessarily be construed as limited to addressing any of the particular problems or deficiencies discussed herein.

In one embodiment is provided stabilized smokeless tobacco, comprising smokeless tobacco, at least one chelator, optionally at least one lipid-soluble antioxidant, and optionally at least one water-soluble antioxidant, wherein the at least one chelator is present in an amount effective to reduce an amount of free calcium in the smokeless tobacco by about 20% or more, and/or reduce an amount of free iron in the smokeless tobacco by about 60% or more.

In another embodiment is provided a method for producing stabilized smokeless tobacco, comprising combining smokeless tobacco with at least one chelator, optionally at least one lipid-soluble antioxidant, and optionally at least one water-soluble antioxidant, wherein the at least one chelator is present in an amount effective to reduce an amount of free calcium in the smokeless tobacco by about 20% or more, and/or reduce an amount of free iron in the smokeless tobacco by about 60% or more.

DEFINITIONS

Figure 1A:
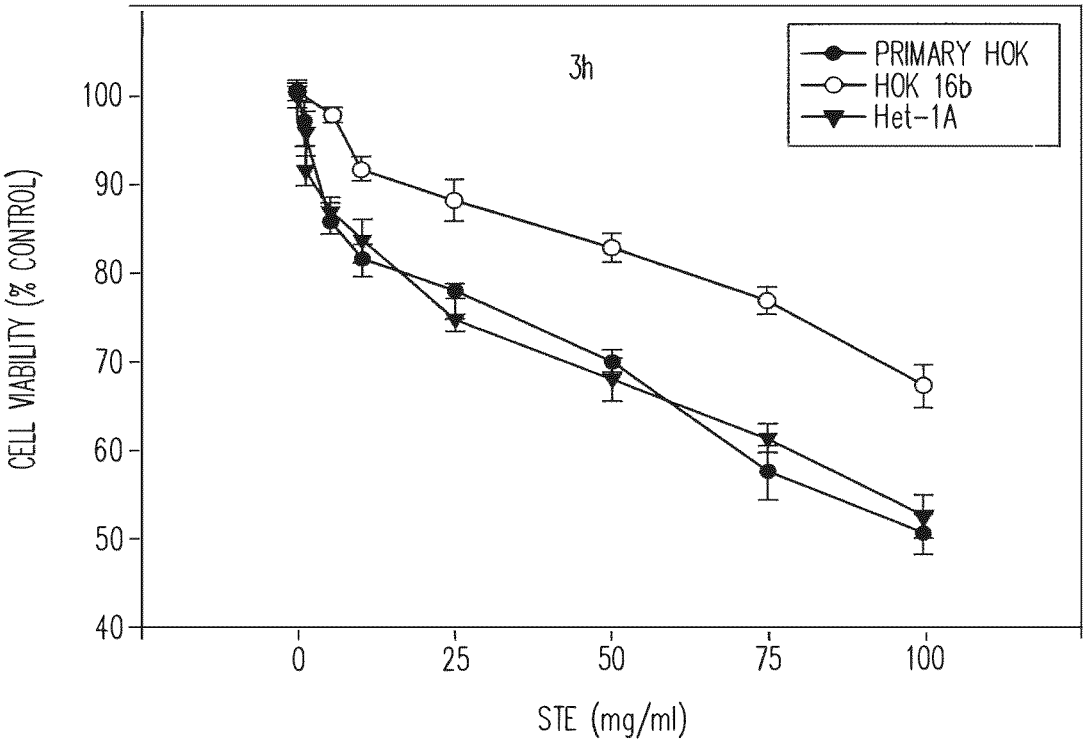
FIG. 1A shows that exposure to smokeless tobacco extract (STE) results in loss of viability of human oral keratinocyte (HOK) cells in a dose-dependent manner.

Unless otherwise defined herein or below in the remainder of the specification, all technical and scientific terms used herein have meanings commonly understood by those of ordinary skill in the art to which the disclosure belongs.

As used herein, the term "smokeless tobacco" denotes orally enjoyable tobacco. The smokeless tobacco may be loose or pre-portioned. This includes moist smokeless tobacco (MST) in orally used pouches (snus pouches). It also includes portions that are preferably free of a fabric and/or paper wrapper and comprise orally enjoyable tobacco that has been molded or divided into individual servings prior to use, such that the pre-portioned tobacco can be placed in a user's mouth without the need for the user to determine an amount to use. Forms of smokeless tobacco are described in, for example, commonly-assigned U.S. Pat. Publication Nos. 2009/0038631, 2008/0202533, and 2009/0301505, each of which is incorporated herein by reference in its entirety.

The phrase "stabilized smokeless tobacco" as used herein means smokeless tobacco that includes at least one chelator, at least one lipid-soluble antioxidant, and at least one water-soluble antioxidant.

The term "free" with regard to (1) calcium and (2) iron refers to (1) $Ca^{2+}$ and (2) $Fe^{2+}$ and/or $Fe^{3+}$, respectively. Determination of an amount of free iron and/or free calcium in smokeless tobacco can be made by first incubating the smokeless tobacco with any chelators that may be used for an appropriate amount of time (for example, one day), then separating extract by centrifugation with glass beads. For example, first four grams of smokeless tobacco can be placed into a Vectrospin™ 20 (Whatman; polypropylene 0.45 um in a 50ml centrifuge tube, Cat. # 6832-0408) in which the filter portion had been removed. Then, fifteen grams of Glass Beads (Kimble; 6 MM catalog # 13500-6) can be added to the Vectrospin™ tube containing the tobacco. The tube is preferably centrifuged at 2200 g for 20 minutes to recover tobacco extract. Free calcium and iron can be measured using the respective QuantiChrom™ assay kits (BioAssay Systems, Hayward, CA) according to the manufacturer's instructions.

The term "tocopherols" includes alpha, beta, gamma, and delta tocopherols.

The term "tocotrienols" includes alpha, beta, gamma, and delta tocotrienols.

The term "lipid-soluble antioxidant" includes particular compounds incorporating moieties that contribute to water solubility and which are therefore water-soluble to some extent, as described in greater detail below.

The term "EDTA" means ethylenediamine tetraacetic acid and includes salts thereof (for example, the calcium and di-sodium salts of EDTA). The term "EGTA" means ethylene glycol tetraacetic acid and includes salts thereof.

Furthermore, as recognized by one of ordinary skill in the art, when certain compounds are disclosed herein, their equivalent salts and other derivatives may also be used.

As used herein, the term "about" when used in conjunction with a stated numerical value or range has the meaning reasonably ascribed to it by a person skilled in the art, i.e. denoting somewhat more or somewhat less than the stated value or range, to within a range of ±10% of the stated value.

It is to be understood that the terminology used in the specification is for the purpose of describing particular embodiments, and is not necessarily intended to be limiting. As used in this specification and the appended claims, the singular forms "a," "an," and "the" do not preclude plural referents, unless the content clearly dictates otherwise.

DETAILED DESCRIPTION

Smokeless Tobacco

Suitable types of tobacco include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. The starting tobacco for preparing MST is preferably dark fire cured tobacco as typically used for moist snuff in the United States, however other types of tobacco may be used. Preferably, the tobacco material is pasteurized. Some or all of the tobacco material may be fermented. As processing steps in preparing smokeless tobacco, a casing material may be applied to the tobacco, the tobacco may be aged, and one or more types of tobacco (e.g., different varieties, having different ages, from different fields, etc.) may be blended to ferment together, or a combination of such steps may be used. Such treatments are preferably performed prior to optional fermentation of the tobacco, but less preferably may be performed following fermentation. If the tobacco is fermented, chelator and optional antioxidant addition is preferably accomplished after fermentation.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may optionally include a supplemental amount of vegetable or plant fibers or particles, such as particles of shreds of lettuce, cotton, flax, beet fiber, cellulosic fibers, blends thereof and the like.

A flavorant may be added to the smokeless tobacco. Suitable flavorants include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

Humectants can also be added to the tobacco material to help maintain the moisture levels in the portioned tobacco product. Examples of humectants that can be used with the tobacco material include glycerol, glycerine, triethylene glycol, and propylene glycol. The humectants may also be provided for a preservative effect, as the water activity of the product can be decreased with inclusion of a humectant. In turn, the opportunity for growth of microorganisms is diminished. Additionally, humectants can be used to provide a higher moisture feel to a drier tobacco component.

The stabilized smokeless tobacco preferably has a moisture level of 10% or greater by weight, for example, 10 to 60%, e.g., 10, 15, 20, 25, 30, 35, 40, 45, 50, 55, or 60%, as desired. A preferred moisture level is about 50% by weight for MST.

The smokeless tobacco is optionally prepared into portioned products, described in, for example, commonly-assigned U.S. Pat. Publication Nos. 2009/0038631, 2008/0202533, and 2009/0301505, each of which is incorporated herein by reference in its entirety.

Iron in Smokeless Tobacco

Transition metals such as iron, when present in the free form, are redox-active and can promote the generation of reactive oxygen species leading to oxidation of lipids, proteins, and other substances (Norberg et al., Free Radic. Biol. Med. 31:1287-1312).

We found that smokeless tobacco typically contains high levels of free iron that appears to be redox active and can lead to oxidation. This free iron can be readily found in extracts of smokeless tobacco. In particular, when smokeless tobacco was centrifuged in a vessel having a screen so that a liquid extract was obtained below the screen, the resulting extract contained high levels of free iron (approximately 200 micromolar).

Additionally, the level of free iron in saliva at the oral site of human use of smokeless tobacco was found to be approximately 100 micromolar (this represents an average of samples from nine subjects).

We have also found that stored pouches of snus exhibit signs of oxidative stress (for example, signs of the consumption of oxygen, a decrease in antioxidant capacity, and increased in lipid peroxidation). We believe that the presence of free iron in smokeless tobacco contributes to this oxidative stress.

Furthermore, a recent report indicated that changes in the sensory quality of iron fortified rice-based foods during storage results from the presence of free iron, and this sensory deficit can be prevented with the addition of the iron chelator sodium citrate (Porasuphatana, S. Journal of Food Science 2008 73:S359-S366).

Consequently, to prevent the oxidation during storage of smokeless tobacco and/or other ingredient components of smokeless tobacco (such as flavors), it is desirable to provide for the chelation of this free iron (and other redox-active transition metals). Thus, in order to reduce oxidation during storage, the stabilized smokeless tobacco includes at least one chelator.

Preferably, at least one chelator is effective to reduce an amount of free iron in the smokeless tobacco by about 60% or more, or optionally by about 40%, 50%, or 70%, or more.

Calcium in Smokeless Tobacco Activates Degradative Enzymes in Storage

High levels of free calcium (10 to 100 millimolar) activate numerous degradative enzymes (such as phospholipase A2, proteases, and amylase) that are found in tobacco (Fujikawa, R. et. al. Lipids 2005 40:901-908). Such enzymes can also be released from microbes that might be found in forms of smokeless tobacco (e.g., fermented tobacco). See, for example, commonly-owned U.S. Pat. Application Publication No. 2008/0156338, incorporated herein in its entirety. The activation of such enzymes results in the release of cellular constituents, such as free unsaturated fatty acids (e.g. oleic acid), that can be easily oxidized, especially in the presence of free iron. Accordingly, reducing the activity of degradative enzymes is expected to improve the shelf life of smokeless tobacco.

Extracts of smokeless tobacco were found to have approximately 135 mM free calcium. We also found that users of smokeless tobacco had about 135 mM free calcium in saliva at the site of use of smokeless tobacco.

We have also found that when snus pouches are stored, quantities of free oleic acid increase, suggesting that degradative enzymes are active during storage. Conditions that promote tobacco or product ingredients degradation and oxidation will likely result in a decline in the sensory attributes of the product during storage, thereby effectively reducing shelf life. Therefore, to maintain the sensory attributes of smokeless tobacco during storage (that is, to enhance shelf life), in an embodiment a calcium chelator such as EDTA and/or citric acid (or its salts) is added to smokeless tobacco. Preferably, the adding is done prior to storage, and prior to retail distribution of the smokeless tobacco. For example, a quantity of a solution of 15% EDTA and/or 10% citric acid can be added to smokeless tobacco prior to storage to prevent the activation of degradative enzymes in tobacco, thus extending the shelf life of the product.

Preferably, at least one chelator is effective to reduce an amount of free calcium in the smokeless tobacco by about 20% or more, or optionally by about 10%, 15%, or 25%, or more.

Chelation of Free Calcium and Free Iron to Maintain Sensory Attributes of Smokeless Tobacco Some flavorants, in particular those involving citric acids, rapidly form chelates when high levels of calcium or iron are present (Kustov A.V. J. Phys. Chem. B 2009. 113:9547-9550). Such chelation is expected to alter the sensory attributes of such flavorants. Calcium salts of such polycarboxylic acid flavors are expected to have limited solubility in aqueous systems, which would likely affect the expected flavor of such a substance. Thus, to maintain sensory attributes contributed by such flavors during storage (thereby improving shelf life), preferably a transition metal chelator such as EDTA and/or citric acid (or its salts) is added to the product prior to the addition of the flavorant. An example is to add an aqueous solution of 15% EDTA and/or an aqueous solution of 10% citric acid to MST prior to flavorant addition and storage to prevent chelation of the flavorant and extend the shelf life of the product.

Chelators and Antioxidants Provide a Protective Effect In Vitro Against Smokeless Tobacco Extract Oral mucosal keratinocytes are the first cells exposed to a smokeless tobacco product upon its placement in the oral cavity, and they serve as a physical barrier that protects underlying cells and tissue from potential adverse effects of the product. Oral mucosal ulceration (from cell death of keratinocytes) and inflammation have been reported within 2 days following MST placement at a new oral site (Johnson et al, "Development of smokeless tobacco-induced oral mucosal lesions." J. Oral Pathol. Med. 27, 388-394 (1998) and Payne et al. "Histological alterations following short-term smokeless tobacco exposure in humans." J Periodontal. Res 33, 274-279 (1998)). It is desirable to avoid damage to oral keratinocytes.

Our studies were conducted using three different types of epithelial oral keratinocytes: primary human oral keratinocytes (HOK), HOK-16B, which is a normal human oral keratinocyte-derived line immortalized by transfection with HPV-16 genome, and the Het-lA immortalized human esophageal epithelial cell line.

Extracts of smokeless tobacco were prepared in cell growth medium as follows. One gram of reference smokeless tobacco was mixed with 10 ml of cell growth medium and placed on a shaker at 300 rpm and allowed to mix for 2 hours at 37° C. It was then centrifuged at 125 g for 10 minites at 4° C. The extracted supernatant was collected and centrifuged at 14,000 g for 1 hour at 4° C. The supernatant was filtered using a 0.22 μm filter, divided into aliquots, and immediately stored at -80° C. The extracted supernatant yielded a 100 mg/ml smokeless tobacco extract (STE) solution, which was serially diluted to obtain the doses of STE (1-100 mg/ml) used.

The primary HOK cells, isolated from human oral mucosa, were plated on poly-L-lysine coated plates at a density of $5 \times 10^5$ cells/well in a 12-well plate and cultured in keratinocyte medium at 37° C. in a humidified atmosphere containing 5% $CO_2$ (v/v). HOK-16B cells were plated at a density of $5 \times 10^5$ cells/well in a 12-well plate and cultured in keratinocyte growth medium supplemented with 0.1 ng/ml epidermal growth factor, 5 μg/ml insulin, 30 μg/mlgentamicin, and 50 μg/mlamphoterecin at 37° C. in a humidified atmosphere containing 5% CO2 (v/v). The Het-1A cells were attached to plates pre-coated with LHC-9 medium supplemented with 0.01 mg/ml fibronectin, 0.03 mg/ml bovine collagen type I and 0.01 mg/ml bovine serum albumin for 1 hour, at a density of $5 \times 10^5$ cells/well in a 12-well plate and cultured in LHC-9 medium at 37° C. in a humidified atmosphere containing 5% CO2 (v/v). Unless otherwise indicated, cells were exposed to STE at 24 hours after plating.

Cells were treated with TROLOX (6-hydroxy-2,5,7,8-tetramethylchroman-2-carboxylic acid, a water-soluble derivative of vitamin E) at 20 μmol/L, L-ascorbic acid (50 μmol/L), or deferoxamine (50 μmol/L) 30 min prior to STE addition. Treatment was from a 10 mM stock solution of each agent, and the maximal concentration of vehicle [dimethyl sulfoxide (DMSO)] in culture medium was 0.01% (v/v). When possible, agents were diluted in appropriate cell culture medium (TROLOX, L-ascorbic acid, deferoxamine). Exposure to STE is expressed in terms of the amount of reference MST used to produce the total volume of STE [i.e., 100 mg/ml (w/v)]. The indicated concentrations of STE (1-100 mg/ml) exposure were chosen for these studies because they are within the reference range of previously cited works involving smokeless tobacco exposure (Bagchi et al., "Smokeless tobacco, oxidative stress, apoptosis, and antioxidants in human oral keratinocytes.: Free Radic. Biol. Med. 26, 992-1000 (1999); Mangipudy et al., "Role of nitric oxide in the induction of apoptosis by smokeless tobacco extract." Mol Cell Biochem. 200, 51-57 (1999); and Petro, "Modulation of IL-12 p35 and p40 promoter activity by smokeless tobacco extract is associated with an effect upon activation of NF-kappaB but not IRF transcription factors." Int. Immunopharmacol. 3, 735-745 (2003)) and do not exceed those concentrations present in the human oral cavity during smokeless tobacco product use (Petro, 2003).

Morphologic assessment of viable cells and apoptotic and necrotic cell death was performed as follows. Cells were harvested 3 hours after STE exposure, unless otherwise noted, by treatment with trypsin-EDTA for approximately 5 minutes at 37° C. As some apoptotic cells detached from the culture substratum into the medium, these cells were also collected by centrifugation of the medium at 125 g for 5 minutes. The pooled cell pellets were resuspended, and a fraction of the suspension was centrifuged onto glass slides in a cytospinner. The slides were fixed and stained utilizing a Hema 3 staining kit and viewed under a light microscope. Nuclear and total cellular morphology were evaluated. Viable cells exhibited an intact, rounded plasma membrane with dark purple cytoplasm and a normal, intact, orange-stained nucleus. Apoptotic cells were identified as those whose nuclei clearly exhibited nuclear fragmentation or the presence of apoptotic bodies and were light grey in appearance. Necrotic cells had compromised plasma membrane integrity as demonstrated by a swollen cell with light orange cytoplasm or a lysed plasma membrane. Hema 3 staining was used to identify total cell numbers and total numbers of apoptotic and non-apoptotic cell death. Trypan blue staining was also routinely used to confirm the necrotic cell death results observed with Hema 3 staining. Five hundred cells from several randomly chosen fields were counted, and the number of dead cells were counted and expressed as a percentage of the total number of cells counted.

The intracellular generation of reactive oxygen species (ROS) was measured by using membrane permeable oxidation-sensitive fluorescent dye DCFH-DA. HOK-16B cells were plated at a density of $2 \times 10^5$ cells/well in a 96-well plate. Fluorescence measurements were obtained 0 to 3 hours after STE addition, at the indicated concentrations, with a plate reader. Thirty minutes before the measurement of ROS in the plate reader, cells were incubated with DCFH-DA (25 μmol/L) or DMSO vehicle. The medium was then rapidly removed, the cells were washed in ice-cold phosphate-buffered saline and replaced with medium lacking dye, and the plate was placed into the plate reader. Data at each time point are presented corrected for basal fluorescence of vehicle-treated cells at the same time point. Each time point represents the mean of six data points per experiment and a total of three independent experiments.

Free iron levels in control medium and STE (100 mg/ml) were measured using a quantitative colorimetric (590 nm) technique to measure total free iron levels. Samples were analyzed using a 96-well plate format with a plate reader. Each data point represents the mean of three independent experiments, each of which included two technical replicates.

As seen in FIG. 1A, exposure to smokeless tobacco extract (STE) results in loss of human oral keratinocyte (HOK) cell viability in a dose-dependent manner. Primary HOK, HOK-16B, or Het-lA cells were cultured and treated where appropriate with vehicle (control medium) or STE (1-100 mg/ml). In each study, each assay was done in triplicate, and the data shown are the mean of three separate studies. The error bars are the standard error of the mean. The dose-dependent necrotic cell death occurred in all three HOK cell lines (FIG. 1A). Necrotic cell death was observed as early as 30 minutes following STE exposure at the highest dose (data not shown). Necrotic cell death was the predominant form of cell death observed in all three cell lines and treatment groups, with a small percentage of apoptotic cells observed following 3 hours of treatment with STE (using a morphological assessment of cell viability and cell death as described above). We believe that 3 hours of continuous exposure using the STE levels of the present study is clinically relevant and serves as an appropriate cell model system to investigate STE induced cell death processes.

Figure 1B:
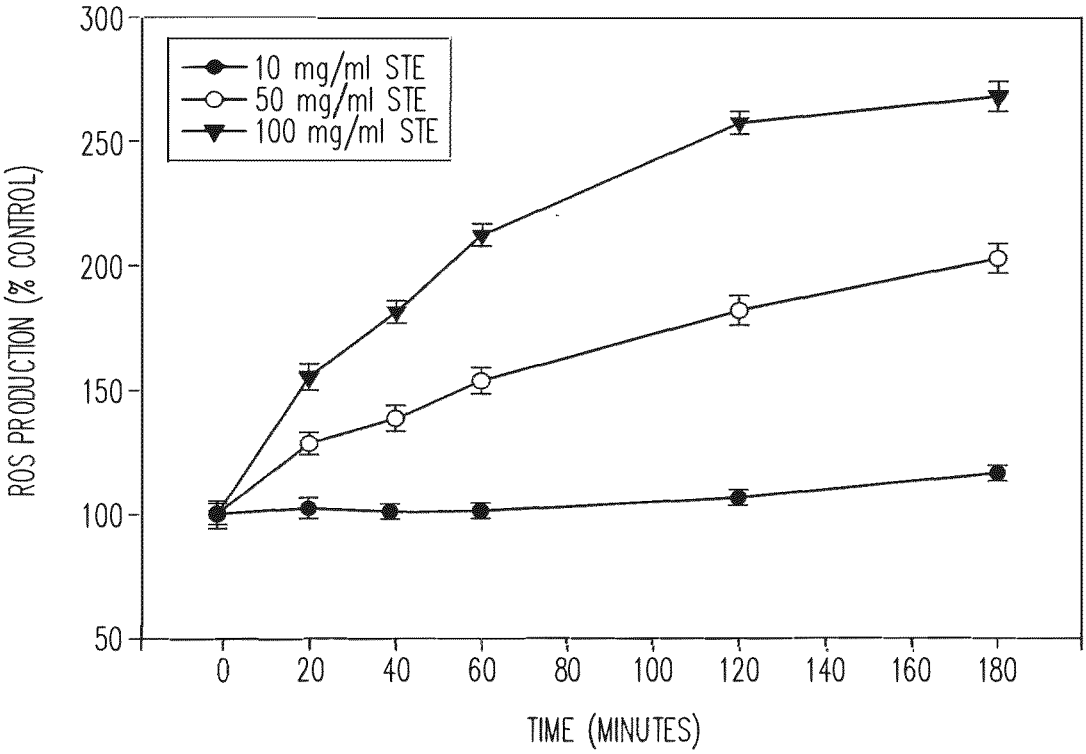
FIG. 1B illustrates that STE promotes reactive oxygen species (ROS) generation in a time- and dose-dependent manner, and that this is significantly reduced by inclusion of antioxidants.
Figure 1C:
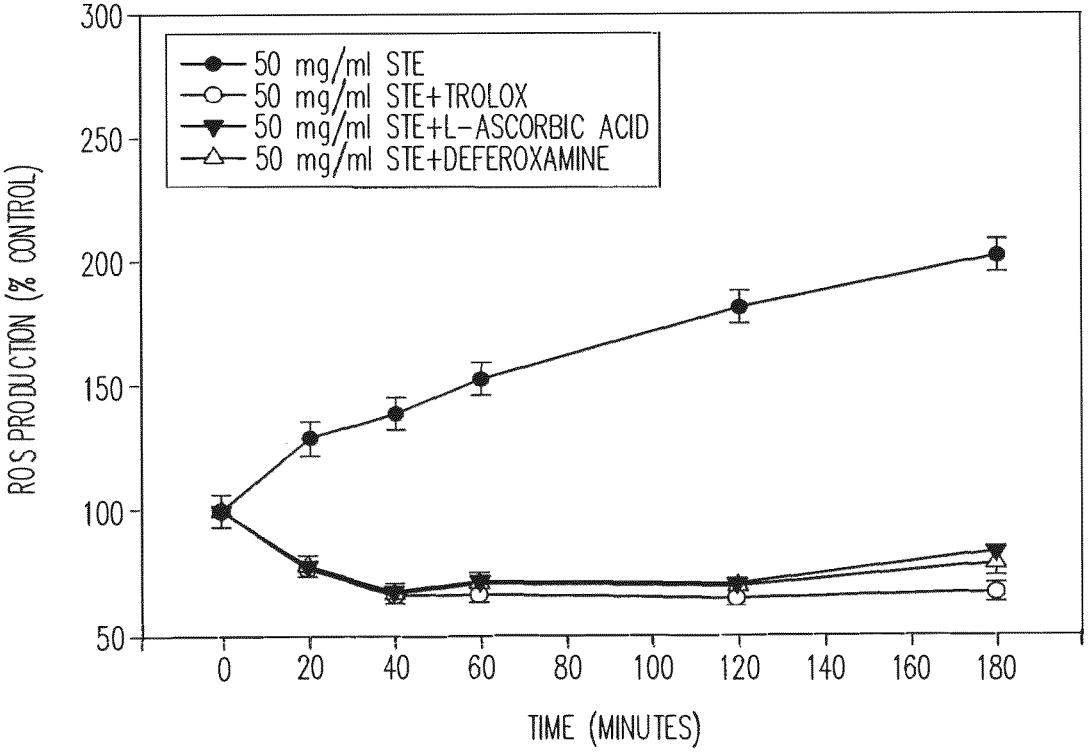
FIG. 1C illustrates that STE promotes reactive oxygen species (ROS) generation in a time- and dose-dependent manner, and that this is significantly reduced by inclusion of antioxidants.

Oxidative stress has been implicated as a mechanism to explain STE-induced cell death in multiple established cell lines, including HOK. FIGS. 1B and 1C illustrate STE promotes reactive oxygen species (ROS) generation in a time- and dose-dependent manner that is significantly reduced by inclusion of antioxidants. The data shown are the means of six separate determinations from one representative experiment (n = 3) and the error bars are the standard error of the mean. In particular, we found that Het-lA (data not shown) and HOK-16B cells showed a dose-dependent increase in ROS production after about 20 to about 180 minutes of exposure to STE (FIG. 1B). The production of ROS was completely suppressed by the inclusion of antioxidants TROLOX or L-ascorbic acid, as well as deferoxamine, an iron chelator (FIG. 1C).

Figure 1D:
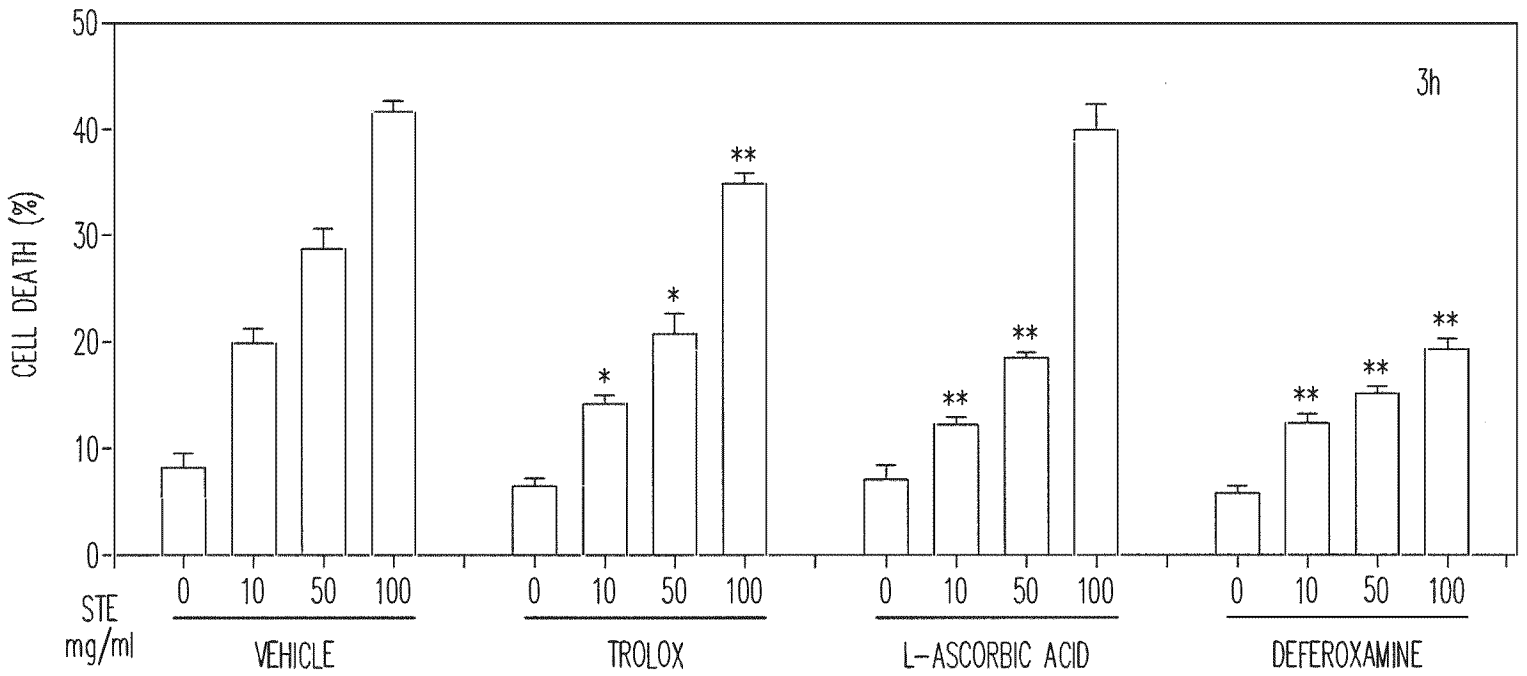
FIG. 1D shows that the antioxidants TROLOX and ascorbic acid, and the chelator deferoxamine, can protect against cell death induced by STE.

As seen in FIG. 1D, the inhibition of ROS generation provided partial protection of HOK-16B cells from STE-induced cell death, with the chelator deferoxamine providing greater protection than the antioxidants. Each cell survival assay was done in triplicate and the data are the mean of three separate studies. The data shown represent the means (± SEM) of replicate samples. The statistical significance of treatment effects shown in FIG. 1D was assessed using a two-tailed Student's t-test comparing treatments to corresponding vehicle control. A single star (*) represents $p<0.05$, less than corresponding treatment value in vehicle treated cells, SEM, and a double star (**), $p<0.005$, less than corresponding treatment value in vehicle treated cells. These data suggest that in addition to oxidative stress, other mechanisms play an important role in STE-induced acute cell death.

These results indicate that, in vitro, treatment with water- or lipid-soluble antioxidants prevents STE-induced ROS production as well as protects oral keratinocytes from the toxic effect of acute STE exposure, and further that the chelator deferoxamine protects against STE-induced acute toxicity. These data suggest that redox-active free iron, present intracellularly or extracellularly (in the STE), plays a critical role in STE-induced cell death. This possibility is supported by our finding that the total free iron concentration of 100 mg/ml STE (29.4 ± 0.5 μM) was reduced to 12.7 ± 0.5 μM following exposure to 50 μM deferoxamine (cell culture medium total free iron concentration was 4.9 ± 0.6 pM). Furthermore, exposing HOK-16B cells to increasing concentrations of free iron alone (0, 14, 31, and 71 pM) in cell culture medium (without STE) using FeCl3 resulted in a dose-dependent increase in the percent necrotic cell death after 3 hours (4.9 ± 0.6%, 13.4 ± 1.0%, 26.2 ± 3.5%, and 37.9 ± 4.5%, respectively).

MST Extract Contains High Levels of Calcium That Contribute to In Vitro Cell Wounding Measurements of free calcium found in extract from MST revealed that the concentration of free $Ca^{2+}$ in MST extract is more than 20 times higher than that found in the cell medium used to prepare the extract.

We found that a "washed" MST preparation, in which MST-associated chemicals were removed but the tobacco material retained, causes cell wounding as indicated by the uptake through plasma membrane disruptions of a fluorescent marker normally impermeable to the cell. This indicated that a mechanical or non-chemical aspect of exposure to MST plays a role in cell wounding.

In order to directly test whether high levels of calcium also contribute to cell wounding, we exposed cells to high calcium medium in the presence and absence of cell wounding. We prepared a 13.5 mM $Ca^{2+}$ medium, based on the measured free $Ca^{2+}$ levels in MST-extract, and used washed MST to induce cell wounding during a 30 minute treatment on the platform rocker exposure system. Cell death was measured immediately following treatment.

Exposure to the high $Ca^{2+}$ medium alone yielded relatively low levels of necrotic cell death, similar to those observed during vehicle treatments. In contrast, when cells were exposed to high $Ca^{2+}$ medium in combination with washed MST, cell death increased significantly to over 45%, indicating that high extracellular calcium in the presence of cell wounding is playing an important role in driving cell death.

To further confirm the important role of calcium, we added the chelator EGTA to reduce free calcium levels in the high $Ca^{2+}$ medium to less than 2 mM, which is a concentration known to facilitate cell wound repair. Treatment of cells with this preparation in combination with washed MST yielded a significantly reduced degree of cell death. This level of cell death was similar to that found with cells treated with washed MST alone and further highlights that high levels of $Ca^{2+}$ in MST-extract appears to play an important role in inducing cell death under conditions that cause cell wounding.

We further found that calcium chelators reduced cell death associated with MST-extract exposure during cell wounding. Given that cell death was significantly reduced by chelating calcium in the high concentration $Ca^{2+}$ medium, we investigated if similar results could be achieved by using this approach to reduce cell death associated with MST-extract exposure. In order to identify the proper concentration of two calcium chelators, EDTA and EGTA, we tested the reduction in free calcium of MST-extract at several concentrations of each chelator. Based on these results, we prepared MST-extract containing 9.5 mM EDTA or EGTA (which we found was sufficient to chelate nearly all of the free calcium) for use in subsequent exposures.

We then treated cells for 30 minutes with MST-extract/chelator preparations in the presence of washed MST using the platform exposure system and assessed cell death immediately following treatment. Both EGTA and EDTA reduced cell death associated with MST-extract exposure during cell wounding. The reduction in cell death associated with EDTA reaches statistical significance (One-way ANOVA, $p < 0.001$; Holm-Sidak comparing washed MST/MST-extract to washed MST/MST-extract/EDTA, $p < 0.001$) whereas the EGTA associated cell death reduction does not (Holm-Sidak comparing washed MST/MST-extract to washed MST/MST-extract/EDTA, $p = 0.108$). Nonetheless, these results further implicate free calcium in MST-extract as playing an important role in cell death during cell wounding in vitro.

Chelators and Antioxidants for Smokeless Tobacco

Described below are exemplary chelators and antioxidants that may be used with smokeless tobacco, however other chelators and antioxidants may be used. Preferably, smokeless tobacco includes at least one chelator, at least one lipid-soluble antioxidant, and at least one water-soluble antioxidant. In the below lists of potential chelators and antioxidants, the quantities thereof are provided in weight percent of the smokeless tobacco containing the at least one chelator and optional antioxidants. Reference to reductions in free iron and/or calcium achieved by a chelator are made in reference to an amount present in the smokeless tobacco absent the chelator.

Preferred chelators include EDTA, EGTA, sodium citrate, sodium tripolyphosphate, deferoxamine, and chlorogenic acid. When the chelator is EDTA, a preferred amount in the smokeless tobacco ranges from about 0.1% to about 0.44%, for example 0.175%. When the chelator is EGTA, a preferred amount in the smokeless tobacco ranges from about 0.05% to about 0.2%. Most preferably, the total amount of EDTA and EGTA together is no more than 0.44%. When the chelator is sodium citrate, a preferred amount in the smokeless tobacco ranges from about 0.025% to about 1%. When the chelator is sodium tripolyphosphate, a preferred amount in the smokeless tobacco ranges from about 1.0% to about 5.0%.

As described above, it is believed that chelators will be effective in reducing or eliminating undesired redox activity of free iron, and in reducing or eliminating calcium-induced activity of degradative enzymes.

Additionally, it is expected that chelators can act to reduce the growth of microorganisms that can be found in smokeless tobacco, for example smokeless tobacco that has been subject to fermentation. For example, others have found that EDTA and EGTA individually reduced capsule production of *Klebsiella pneumoniae*. See Domenico et al., 1989, Infection and Immunity, 57:3778-3782, incorporated herein by reference. Microbes in smokeless tobacco are expected to undesirably produce degradative enzymes that would act to reduce shelf life. In an embodiment, at least one chelator is present in smokeless tobacco in an amount effective to inhibit growth of microorganisms. Optionally, the tobacco is fermented prior to addition of a chelator.

Preferred lipid-soluble antioxidants include tocopherols, tocotrienols, beta-carotene, alpha tocopheryl succinate, alpha tocopheryl acetate, tocopheryl polyethylene glycol succinate, ascorbyl palmitate, butylated hydroxyanisole (BHA), butylated hydroxytoluene (BHT), tert-butylhydroquinone (TBHQ), and ubiquinol. Especially preferred is a mixture of tocopherols, for example a mixture comprising predominantly gamma tocopherol and alpha tocopherol, with lesser amounts of beta and delta tocopherols. Although a certain degree of water solubility is conferred by the succinate esters in the compounds alpha tocopheryl succinate and tocopheryl polyethylene glycol succinate, these compounds are grouped herein with the lipid-soluble antioxidants. It is expected that the ester linkages in these compounds could gradually hydrolyze during storage of smokeless tobacco (which preferably has a pH of near 8.0), advantageously providing for sustained release of the corresponding lipid-soluble antioxidants.

Tocopheryl polyethylene glycol succinate is a preferred form of antioxidant. Although grouped herein with the lipid-soluble antioxidants, it is highly water soluble with a solubility of 200 g/liter. During storage of smokeless tobacco, it is expected that the ester linkages in the tocopheryl polyethylene glycol succinate will gradually hydrolyze to release tocopherol (which is a lipid-soluble functional antioxidant), polyethylene glycol (PEG 1000), and succinate. Before such hydrolyzation occurs, tocopheryl polyethylene glycol succinate is not active as an antioxidant.

Tocopheryl polyethylene glycol succinate is also expected to advantageously act as a humectant in smokeless tobacco, and to act as a coating to protect flavors.

Most preferably, the total amount of the lipid-soluble antioxidant in smokeless tobacco is about 0.35% or less. When the lipid-soluble antioxidant is a tocopherol, a preferred amount in the smokeless tobacco ranges from about 0.01% to about 0.35%. When the lipid-soluble antioxidant is beta-carotene, a preferred amount in the smokeless ranges from about 0.01% to about 0.05%. When the lipid-soluble antioxidant is ascorbyl palmitate, a preferred amount in the smokeless tobacco ranges from about 0.01% to about 0.22%. Most preferably, the total amount of tocopherols, tocotrienols, and derivatives thereof in smokeless tobacco totals about 0.35%.

Preferred water-soluble antioxidants include ascorbic acid (which includes salts thereof such as sodium L-ascorbate), gallic acid, and chlorogenic acid. When the water-soluble antioxidant is ascorbic acid, a preferred amount in the smokeless tobacco ranges from about 0.025% to about 1.5%, for example about 0.5% or about 1.0%. When the water-soluble antioxidant is gallic acid, a preferred amount in the smokeless tobacco ranges from about 0.005 to about 0.02%. Most preferably, the total amount of ascorbic acid and its derivatives (including ascorbyl palmitate and sodium L-ascorbate) is about 1.5% or less.

To combine the smokeless tobacco with the at least one chelator and optional antioxidants, a variety of methods can be used. Preferably, relatively concentrated solutions of these compounds can be prepared and added to the smokeless tobacco, for example by mechanical mixing and/or spraying. For example, EDTA can be added using a solution containing 15% EDTA, and citric acid can be added using a solution containing 10% citric acid. Lipid-soluble compounds may be soluble in alcohol and can be added in the form of an alcohol solution, optional along with one or more flavors. Most preferably, the at least one chelator and optional antioxidants are intimately co-mingled with the smokeless tobacco. Optionally, the at least one chelator and/or optional antioxidants can be added at more than one stage of preparing the smokeless tobacco.

The use of chelators to bind free iron and/or calcium, in conjunction with antioxidants, is expected to reduce oxidative damage to smokeless tobacco, reduce degradation of tobacco and flavor components resulting from enzyme activation (calcium-dependent), and/or prevent the loss of sensory attributes of the smokeless tobacco product (metal binding to flavor molecules such as citric acid resulting in a loss of expected taste). Most preferably, metal chelators in combination with water-soluble and lipid-soluble antioxidants are used to prevent oxidative damage to the smokeless tobacco product. Chelators such as EDTA are also expected to act to reduce the growth of microbes in smokeless tobacco. Antioxidants may also have such an effect. Use of one or more chelators and antioxidants should lead to the enhanced maintenance of smokeless tobacco product color, smell, and taste during storage.

Although the invention has been described with reference to particular embodiments and examples, it should be understood that various modifications can be made without departing from the spirit of the invention. The various parts of the disclosure including the abstract, summary, and the title are not to be construed as limiting the scope of the present invention, as their purpose is to enable the appropriate authorities, as well as the general public, to quickly determine the general nature of the invention. Unless the term "means" is expressly used, none of the features or elements recited herein should be construed as means-plus-function limitations.

What is claimed is:

1. A method of treating smokeless tobacco, comprising:
adding at least one first chelator to smokeless tobacco;
adding at least one first antioxidant to the smokeless tobacco, the at least one first antioxidant being different than the at least one first chelator; and
adding at least one first flavorant to the smokeless tobacco, wherein the adding of the at least one first chelator occurs before the adding of the at least one first flavorant.

2. The method of claim 1, wherein the adding of the at least one first antioxidant occurs before or after the adding of the at least one first flavorant.

3. The method of claim 1, wherein the adding of the at least one first antioxidant and the adding of the at least one first flavorant occur at a same time.

4. The method of claim 3, wherein the adding of the at least one first antioxidant and the adding of the at least one first flavorant combine to include,
forming an alcohol solution, the alcohol solution including the at least one first flavorant and the at least one first antioxidant, the at least one first antioxidant being at least one lipid-soluble antioxidant; and
adding the alcohol solution to the smokeless tobacco.

5. The method of claim 1, further comprising:
fermenting the smokeless tobacco;
wherein the adding of the at least one first chelator occurs after the fermenting.

6. The method of claim 5, wherein the adding of the at least one first antioxidant occurs after the fermenting.

7. The method of claim 5, wherein
the at least one first chelator includes EDTA, EGTA, sodium tripolyphosphate, deferoxamine, and chlorogenic acid; and
the at least one first antioxidant includes tocopherols, tocotrienols, beta-carotene, alpha tocopheryl succinate, alpha tocopheryl acetate, tocopheryl polyethylene glycol succinate, ascorbyl palmitate, BHA, BHT, TBHQ, and ubiquinol.

8. The method of claim 5, wherein the at least one first chelator includes deferoxamine; and
the at least one first antioxidant includes at least one of a lipid-soluble antioxidant and a water-soluble antioxidant.

9. The method of claim 5, wherein
the at least one first chelator includes sodium tripolyphosphate; and
the at least one first antioxidant includes at least one of a lipid-soluble antioxidant and a water-soluble antioxidant.

10. The method of claim 1, wherein
the adding of the at least one first chelator includes adding the at least one first chelator in an amount that is effective at suppressing reactive oxygen species (ROS) generation caused by free iron and free calcium in the smokeless tobacco.

11. The method of claim 10, wherein the at least one first chelator includes deferoxamine.

12. The method of claim 10, wherein
the at least one first chelator includes sodium tripolyphosphate.

13. The method of claim 10, wherein the at least one first chelator includes chlorogenic acid.

14. The method of claim 10, wherein the at least one first chelator includes EDTA, EGTA, sodium tripolyphosphate, deferoxamine, and chlorogenic acid.

15. The method of claim 1, wherein the adding of the at least one first chelator includes adding the at least one first chelator in an amount effective to, reduce redox activity of free iron in the smokeless tobacco, and reduce calcium-induced activity of degradative enzymes in the smokeless tobacco.

16. The method of claim 15, wherein the at least one first chelator includes deferoxamine; and the at least one first antioxidant includes at least one of a lipid-soluble antioxidant and a water-soluble antioxidant.

17. The method of claim 15, wherein the at least one first chelator includes sodium tripolyphosphate; and the at least one first antioxidant includes at least one of a lipid-soluble antioxidant and a water-soluble antioxidant.

18. The method of claim 1, wherein the at least one first chelator includes EDTA, EGTA, sodium tripolyphosphate, deferoxamine, and chlorogenic acid; and the at least one first antioxidant includes tocopherols, tocotrienols, beta-carotene, alpha tocopheryl succinate, alpha tocopheryl acetate, tocopheryl polyethylene glycol succinate, ascorbyl palmitate, BHA, BHT, TBHQ, and ubiquinol.

19. The method of claim 1, wherein the at least one first chelator includes deferoxamine; and the at least one first antioxidant includes at least one of a lipid-soluble antioxidant and a water-soluble antioxidant.

20. The method of claim 1, wherein the at least one first chelator includes sodium tripolyphosphate; and the at least one first antioxidant includes at least one of a lipid-soluble antioxidant and a water-soluble antioxidant.

21. The method of claim 1, wherein the adding of the at least one first chelator includes adding the at least one first chelator in an amount effective to, reduce an amount of free calcium in the smokeless tobacco by about 20% or more; and reduce an amount of free iron in the smokeless tobacco by about 60% or more.

22. The method of claim 1, wherein the at least one first flavorant has chelating properties.

23. The method of claim 22, wherein the at least one first flavorant includes citric acid.

24. The method of claim 23, wherein the at least one first chelator includes a transition metal chelator; and the at least one first chelator is different than the at least one first flavorant.

25. The method of claim 23, wherein the at least one first chelator includes EDTA, citric acid, or combinations thereof.

26. The method of claim 1, wherein the adding of the at least one first chelator includes, forming an aqueous solution of about 15% EDTA, about 10% citric acid, or about 15% EDTA and about 10% citric acid; and adding the aqueous solution to the smokeless tobacco, the at least one first chelator including the aqueous solution.

27. The method of claim 1, further comprising:

adding at least one second chelator, at least one second antioxidant, or combinations thereof to the smokeless tobacco;

wherein the adding of the at least one second chelator occurs at a different time than the adding of the at least, one first, chelator and the adding of the at least one first antioxidant.

28. The method of claim 1, wherein the adding of the at least one first antioxidant occurs before the adding of the at least one first chelator.

29. A method of treating smokeless tobacco, comprising:

adding at least one first substance to the smokeless tobacco, the at least one first substance including at least one of sodium tripolyphosphate, deferoxamine, chlorogenic acid, or combinations thereof;

adding at least one first antioxidant and at least one second antioxidant to the smokeless tobacco, the at least one first antioxidant and the at least one second antioxidant, being different than the at least one first substance, the at least one first antioxidant being lipid-soluble and the at least one second antioxidant being water-soluble; and adding at least one first flavorant to the smokeless tobacco, wherein the adding of the at least one first substance occurs before the adding of the at least, one first flavorant.

* * * * *